US010202839B2

(12) United States Patent
Scott et al.

(10) Patent No.: US 10,202,839 B2
(45) Date of Patent: Feb. 12, 2019

(54) POWER AND COMMUNICATIONS HUB FOR INTERFACE BETWEEN CONTROL POD, AUXILIARY SUBSEA SYSTEMS, AND SURFACE CONTROLS

(71) Applicant: Hydril USA Distribution LLC, Houston, TX (US)

(72) Inventors: Glen Allen Scott, Houston, TX (US); Damon Paul Blaicher, Houston, TX (US); William Hatter, Houston, TX (US); Jochen Schnitger, Houston, TX (US); Aaron Blinka, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 14/972,848

(22) Filed: Dec. 17, 2015

(65) Prior Publication Data

US 2016/0177700 A1 Jun. 23, 2016

Related U.S. Application Data

(60) Provisional application No. 62/093,029, filed on Dec. 17, 2014.

(51) Int. Cl.
*H04B 13/02* (2006.01)
*E21B 47/00* (2012.01)
(Continued)

(52) U.S. Cl.
CPC ..... *E21B 47/0001* (2013.01); *E21B 33/0355* (2013.01); *E21B 33/064* (2013.01); *E21B 34/16* (2013.01); *E21B 41/0007* (2013.01)

(58) Field of Classification Search
CPC ..... E21B 47/0001; E21B 33/0355; E21B 41/0007; E21B 34/16; E21B 33/064
(Continued)

(56) References Cited

U.S. PATENT DOCUMENTS 3,902,554 A 9/1975 Hooper
4,109,938 A 8/1978 Mitchell et al.
(Continued)

FOREIGN PATENT DOCUMENTS

CA 2 427 171 A1 4/2003
CN 201250646 Y 6/2009
(Continued)

OTHER PUBLICATIONS

McCord, "A Multiplex System for a Small Remotely Manned Submersible", IEEE Ocean 1975, pp. 361-364, 1975.
(Continued)

*Primary Examiner* — Tanmay Shah
(74) *Attorney, Agent, or Firm* — Hogan Lovells US LLP

(57) ABSTRACT

A power and communications hub (PCH) for oil and gas operations is disclosed. The PCH includes a port operable to provide electrical power to a device for use in oil and gas operations; a port operable to provide electrical communications for use in oil and gas operations; a multiplexer (MUX) interface for connection to a MUX cable; a PCH connection interface for connection to at least one additional PCH; and a PCH body. The PCH body is operable to be disposed proximate a blowout preventer (BOP) stack, and the PCH body is physically disposed apart from but in electrical communication with at least one control pod on the BOP stack.

22 Claims, 8 Drawing Sheets

(51) Int. Cl.

| | |
|---|---|
| ***E21B 33/035*** | (2006.01) |
| ***E21B 33/064*** | (2006.01) |
| ***E21B 34/16*** | (2006.01) |
| ***E21B 41/00*** | (2006.01) |

(58) Field of Classification Search
USPC ..... 340/850
See application file for complete search history.

(56) References Cited

U.S. PATENT DOCUMENTS

| | | | |
|---|---|---|---|
| 4,618,173 | A | 10/1986 | Dopyera et al. |
| 4,709,726 | A | 12/1987 | Fitzgibbons |
| 5,314,024 | A | 5/1994 | Rodgers et al. |
| 5,778,918 | A | 7/1998 | McLelland |
| 5,781,192 | A | 7/1998 | Kodimer |
| 5,867,150 | A | 2/1999 | Bricklin et al. |
| 6,040,969 | A | 3/2000 | Winch et al. |
| 6,041,804 | A | 3/2000 | Chatufale |
| 6,835,292 | B2 | 12/2004 | Sato et al. |
| 6,957,205 | B1 | 10/2005 | Liongosari |
| 6,961,226 | B2 | 11/2005 | Mason, Jr. et al. |
| 6,990,498 | B2 | 1/2006 | Fenton et al. |
| 7,000,890 | B2 | 2/2006 | Bell et al. |
| 7,111,874 | B2 | 9/2006 | Smith, III |
| 7,113,668 | B2 | 9/2006 | Sorum et al. |
| 7,216,715 | B2 | 5/2007 | Reynolds |
| 7,261,162 | B2 | 8/2007 | Deans et al. |
| 7,337,848 | B2 | 3/2008 | Fraser et al. |
| 7,558,684 | B2 | 7/2009 | Patten et al. |
| 7,571,772 | B2 | 8/2009 | Reams |
| 7,760,670 | B2 | 7/2010 | Causier |
| 7,832,706 | B2 | 11/2010 | Judge |
| 7,849,599 | B2 | 12/2010 | Huff et al. |
| 7,887,103 | B2 | 2/2011 | Evans et al. |
| 7,913,767 | B2 | 3/2011 | Larson et al. |
| 7,975,770 | B2 | 7/2011 | Keener |
| 8,020,623 | B2 | 9/2011 | Parks et al. |
| 8,054,593 | B2 | 11/2011 | Reid et al. |
| 8,157,025 | B2 | 4/2012 | Johnson |
| 8,157,295 | B2 | 4/2012 | Krywitsky |
| 8,230,735 | B2 | 7/2012 | Chouzenoux et al. |
| 8,322,436 | B2 | 12/2012 | Maa |
| 8,388,255 | B2 | 3/2013 | Larson et al. |
| 8,403,053 | B2 | 3/2013 | Judge |
| 8,464,797 | B2 | 6/2013 | Singh et al. |
| 8,469,048 | B2 | 6/2013 | Bresnahan |
| 8,602,108 | B2 | 12/2013 | Mathis |
| 8,708,054 | B2 | 4/2014 | Dailey, Jr. |
| 8,724,957 | B2 | 5/2014 | Oisel et al. |
| 8,781,743 | B2 | 7/2014 | McKay et al. |
| 8,812,274 | B2 | 8/2014 | Virkar et al. |
| 8,944,403 | B2 | 2/2015 | Jurena et al. |
| 9,057,751 | B2 | 6/2015 | Spencer et al. |
| 9,085,948 | B2 | 7/2015 | Egeland |
| 9,151,794 | B2 | 10/2015 | Radan |
| 2008/0264642 | A1 | 10/2008 | Horton |
| 2010/0300696 | A1 | 12/2010 | McCalvin et al. |
| 2011/0114329 | A1 | 5/2011 | Emecheta et al. |
| 2011/0266002 | A1 | 11/2011 | Singh et al. |
| 2012/0233128 | A1 | 9/2012 | Solmer |
| 2012/0312546 | A1 | 12/2012 | Bussear et al. |
| 2012/0318517 | A1 | 12/2012 | Christensen et al. |
| 2013/0054034 | A1 | 2/2013 | Ebenezer |
| 2013/0118755 | A1 | 5/2013 | Kotrla et al. |
| 2013/0228371 | A1* | 9/2013 | Farrar ..... E21B 21/001 175/5 |
| 2013/0253872 | A1 | 9/2013 | Curtis et al. |
| 2013/0255956 | A1 | 10/2013 | Gilmore et al. |
| 2013/0283919 | A1 | 10/2013 | Coonrod et al. |
| 2014/0061516 | A1 | 3/2014 | Gustafson et al. |
| 2014/0064029 | A1* | 3/2014 | Jaffrey ..... E21B 33/0355 367/81 |
| 2014/0321341 | A1 | 10/2014 | Kristiansen |
| 2014/0361785 | A1 | 12/2014 | Radan |
| 2015/0015066 | A1 | 1/2015 | Dong et al. |
| 2015/0041122 | A1 | 2/2015 | Valsecchi |
| 2015/0101674 | A1 | 4/2015 | Gustafson |
| 2015/0129233 | A1 | 5/2015 | Gaude et al. |
| 2015/0184505 | A1 | 7/2015 | Panicker-Shah |
| 2015/0198001 | A1 | 7/2015 | McWhorter et al. |
| 2015/0233202 | A1 | 8/2015 | Caldwell et al. |
| 2015/0260203 | A1 | 9/2015 | Launonen et al. |
| 2016/0042154 | A1* | 2/2016 | Goldberg ..... G06F 19/327 705/2 |
| 2018/0073320 | A1 | 3/2018 | Holmes et al. |

FOREIGN PATENT DOCUMENTS

| | | | |
|---|---|---|---|
| EP | 2 383 429 | A2 | 11/2011 |
| EP | 2 458 143 | A2 | 5/2012 |
| GB | 2 447 331 | A | 9/2008 |
| WO | 0001915 | A2 | 1/2000 |
| WO | 2013192494 | A1 | 12/2013 |

OTHER PUBLICATIONS

Hickok, "Practical Experience of Control Valve Behavior", Subsea Control and Data Acquisition: Proceedings of an international conference, London, UK, pp. 195-203, Apr. 4-5, 1990.

Martin et al., "A Proven Oil/Water/Gas Flowmeter for Subsea, Offshore Technology Conference", Offshore Technology Conference, Houston, pp. 589-596, May 6-9, 1991.

Ali et al., "Subsea Valve Actuator for Ultra Deepwater", Offshore Technology Conference, Houston, Texas, 1996 proceedings, pp. 799-809, May 6-9, 1996.

Altamiranda et al., "Intelligent Supervision and Integrated Fault Detection and Diagnosis for Subsea Control Systems", OCEANS 2007 Europe, pp. 1-6, Jun. 18-21, 2007.

Wang et al., "Water Hammer Effects on Water Injection Well Performance and Longevity", Society of Petroleum Engineers, SPE International Symposium and Exhibition on Formation Damage Control,Lafayette, Louisiana, USA, pp. 1-10, Feb. 13-15, 2008.

Vetcogray, "Capital Drilling Equipment", retrieved from http://site.ge-energy.com/businesses/ge_oilandgas/en/literature/en/downloads/capital_drilling_equipment.pdf, pp. 1-15, 2008.

Altamiranda et al., "Condition Monitoring and Diagnosis for Subsea Control Systems. A Subsystem Prototype", OCEANS 2009 Europe, pp. 1-6, May 11-14, 2009.

Whitby et al., "20KSI BOP Stack Development", SPE International, pp. 1-5, Feb. 2-4, 2010.

Tang et al., "A Dynamic Simulation Study of Water Hammer for Offshore Injection Wells to Provide Operation Guidelines", SPE Production & Operations, vol. No. 25, Issue No. 4, pp. 509-523, Nov. 2010.

Shanks et al., "OTC 23473 New Generation Control System for 20 KSI Subsea BOP", Offshore Technology Conference, pp. 1-12, May 3, 2012.

Levine et al., "BSEE and BOEM Workshop with Government of Israel Application for Permit to Drill", pp. 1-40, Jul. 24, 2012.

Cai et al., "Reliability Analysis of Subsea Blowout Preventer Control Systems Subjected to Multiple Error Shocks", Journal of Loss Prevention in the Process Industries, vol. No. 25, Issue No. 6, pp. 1044-1054, Nov. 1, 2012.

Cai et al., "Application of Bayesin Networks to Reliability Evaluation of Software Systems for Subsea Blowout Preventers", International Journal of Control and Automation, pp. 47-60, Feb. 28, 2013.

Umofia., "Risk-Based Reliability Assessment of Subsea Control Module for Offshore Oil and Gas production", Cranfield University, School of Engineering, Department of Offshore, Process and Energy Engineering, pp. 1-284, Sep. 2014.

Chazal et al., "Enhancements in Fraction Measurements and Flow Modeling for Multiphase Flowmeters" Society of Petroleum Engineers, SPE Annual Technical Conference and Exhibition, pp. 1-19, Oct. 27-29, 2014.

PCT Search Report and Written Opinion issued in connection with Related Application No. PCT/US2015/053238 dated Feb. 1, 2016.

(56) References Cited

OTHER PUBLICATIONS

PCT Search Report and Written Opinion issued in connection with Related Application No. PCT/US2015/055915 dated Feb. 2, 2016.
GE Oil & Gas, "GE's 20-ksi" BOP Completely Re-Engineered to Meet Demands of HPHT Reservoirs, Drilling Contractor, pp. 1-2, Feb. 17, 2016.
Cameron., "Mark III Subsea MUX BOP Control System", Drilling Pressure Control Equipment, retrieved from http://www.c-a-m.com/products-and-services/drilling/drilling-pressure-control-equipment/mark-iii-subsea-mux-bop-control-system, pp. 1-4, Feb. 19, 2016.
International Search Report and Written Opinion issued in connection with corresponding PCT Application No. PCT/US2015/066374 dated Mar. 21, 2016.
International Preliminary Report on Patentability issued in connection with corresponding PCT Application No. PCT/US2015/066374 dated Jun. 20, 2017.
Holmes, J.S. et al., High Pressure bop system, GE Pending U.S. Appl. No. 62/065,431, filed Oct. 17, 2014.

* cited by examiner

POWER AND COMMUNICATIONS HUB FOR INTERFACE BETWEEN CONTROL POD, AUXILIARY SUBSEA SYSTEMS, AND SURFACE CONTROLS

RELATED APPLICATIONS

This application is a non-provisional application claiming priority to U.S. Provisional Application No. 62/093,029, filed Dec. 17, 2014, which is hereby incorporated herein by reference in its entirety.

BACKGROUND

1. Field of Invention

This disclosure relates in general to oil and gas equipment, and to a power and communications hub (PCH) for use in oil and gas equipment. In particular, the disclosure provides systems and methods that utilize one or more PCHs to distribute power and communications in blowout preventer (BOP) subsea applications.

2. Related Technology

BOP systems are hydraulically-controlled systems used to prevent blowouts from subsea oil and gas wells. Subsea BOP equipment typically includes a set of two or more redundant control systems with separate hydraulic pathways to operate a specified BOP function on a BOP stack. The redundant control systems are commonly referred to as blue and yellow control pods. In known systems, a communications and power cable sends information and electrical power to an actuator with a specific address. The actuator in turn moves a hydraulic valve, thereby opening a fluid path to a series of other valves/piping to control a portion of the BOP.

Historically, power and communications connections have been centralized on BOP control pods subsea. However, subsea safety standards have become more stringent, including a higher demand for subsea condition monitoring. These increased safety and industry standards increase the complexity, and therefore the complications, involved with the interface with subsystems, surface systems, and the subsea control pods.

SUMMARY

By separating BOP electrical interface requirements from subsea control pod(s) on a BOP stack, the present disclosure provides for a modular design with two or more separate PCHs. In certain embodiments, this modular design of the PCH allows a reduction in the requirements on the control pod, such that the control pod controls only hydraulic functions. Thus, separating out the interface system from the control pods according to embodiments of the disclosure increases design expandability and flexibility for current and future designs. In some embodiments, the modular design can prevent time consuming redesign of sophisticated control pods, where new design requirements can be handled by the PCH, such as due to a requirement to add a new condition monitoring subsystem.

In some embodiments, a PCH includes four objectives: multiplexer (MUX) interface; power distribution; communication distribution; and combined power/communications distribution. The PCH absorbs these interfaces from the control pod requirements, thus reducing the complexity of the control pod. In addition, by separating the interfaces from the control pod, a PCH enables design flexibility and increases system reliability.

In certain embodiments, a PCH interfaces with a MUX cable break out device and serves as the central power and communication system for subsea controls. Communication links can be terminated from the MUX output and linked to their appropriate interface. The PCH includes a power system and a communication system. In certain embodiments, the PCH power system converts delta 3 phase 480 volt alternating current (VAC) 60 Hz to 24 volt direct current (VDC) to serve as the primary voltage for a BOP subsea control. In certain embodiments, the PCH communication system serves as a gateway for subsea communications. The PCH communication system can provide a communication crossover to and from the coinciding PCH. The communication crossover can serve as a means of a redundant communication link. In certain embodiments, the PCH can provide fiber optic (FO) monitoring where degradation in optical signal can trigger an automatic switchover to a redundant fiber optic communications pathway.

In some embodiments, the PCH can allow for multiplexer (MUX) communications from a lower BOP stack to surface systems, resulting in a significant simplification from previous designs. In some embodiments, having redundant PCHs can enable the distribution of crossover power, which gives redundant power to the control pod from both MUX cables, and such redundant power can increase reliability. The technology of the present disclosure can reduce the vulnerability of the control pod to non-critical subsystem failures and the need for major redesigns due to downstream changes, as are required in a control pod only system.

Therefore, disclosed herein is a power and communications hub (PCH) for oil and gas operations. The PCH includes, a port operable to provide electrical power to a device for use in oil and gas operations; a port operable to provide electrical communications for use in oil and gas operations; a multiplexer (MUX) interface for connection to a MUX cable; a PCH connection interface for connection to at least one additional PCH; and a PCH body. The PCH body is operable to be disposed proximate a blowout preventer (BOP) stack, and the PCH body is physically disposed apart from but in electrical communication with at least one control pod on the BOP stack.

Also disclosed is a PCH system for subsea oil and gas operations. The PCH system includes a first LMRP PCH. The first LMRP PCH includes a port operable to provide electrical power to a device for use in oil and gas operations; a port operable to provide electrical communications for use in oil and gas operations; a MUX interface for connection to a MUX cable; a PCH connection interface for connection to at least one additional PCH; and a PCH body, wherein the PCH body is operable to be disposed proximate a BOP stack, and wherein the PCH body is physically disposed apart from but in electrical communication with at least one control pod on the BOP stack; a second LMRP PCH; a first lower stack (LS) PCH; and a second LS PCH.

Also disclosed is a method for decentralizing power and communications in subsea BOP stack control pods. The method includes the steps of: introducing at least one PCH to a BOP stack, wherein the PCH is operable to provide power and communications for existing BOP stack components and future BOP stack components; and operating the PCH to provide required power and communications to components on the BOP stack from surface controls, wherein the PCH is physically disposed apart from but in electrical communication with at least one control pod on the BOP stack.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION OF THE DISCLOSURE

So that the manner in which the features and advantages of the embodiments of PCH systems and methods, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
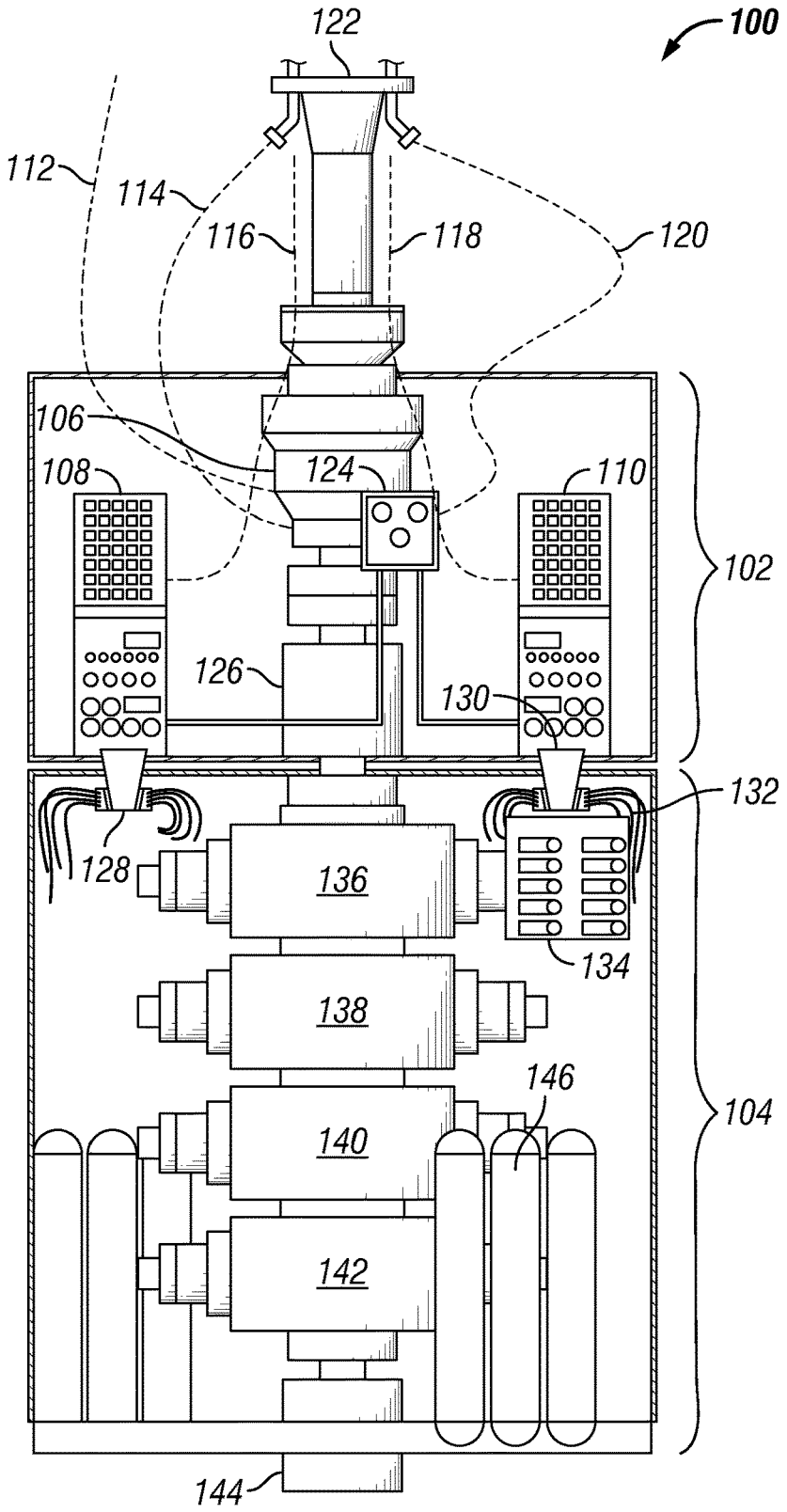
FIG. 1 is a representative system overview of a BOP stack.

Referring first to FIG. 1, a representative system overview of a BOP stack is shown. In FIG. 1, a BOP stack 100 is pictured, which includes a lower marine riser package (LMRP) 102 and a lower stack 104. LMRP 102 includes an annular 106, a blue control pod 108, and a yellow control pod 110. A hotline 112, a blue conduit 114, and a yellow conduit 120 proceed downwardly from a riser 122 into LMRP 102 and through a conduit manifold 124 to control pods 108, 110. A blue power and communications line 116 and a yellow power and communications line 118 proceed to control pods 108, 110, respectively. An LMRP connector 126 connects LMRP 102 to lower stack 104. Hydraulically activated wedges 128 and 130 are disposed to suspend connectable hoses or pipes 132, which can be connected to shuttle panels, such as shuttle panel 134.

Lower stack 104 can include shuttle panel 134, as well as a blind shear ram BOP 136, a casing shear ram BOP 138, a first pipe ram 140, and a second pipe ram 142. BOP stack 100 is disposed above a wellhead connection 144. Lower stack 104 can further include optional stack-mounted accumulators 146 containing a necessary amount of hydraulic fluid to operate certain functions within BOP stack 100.

As noted previously, power and communications connections historically have been centralized on BOP control pods subsea, such as control pods 108, 110. However, subsea safety standards have become more stringent, including a higher demand for subsea condition monitoring. These increased safety and industry standards increase the complexity, and therefore the complications, involved with the interface with subsystems, surface systems, and the subsea control pods. The disclosure provides the ability to separate power and communication connections from the control pods. For example, with power and communication connections, such as a PCH, located proximate the lower stack 104 additional monitoring is possible. Additional monitoring devices can be connected to one or more PCHs on lower stack 104, rather than running a connection through wedges 128, 130 to control pods 108, 110. One or more PCHs can be used to provide power and communications on either or both LMRP 102 and lower stack 104.

Figure 2:
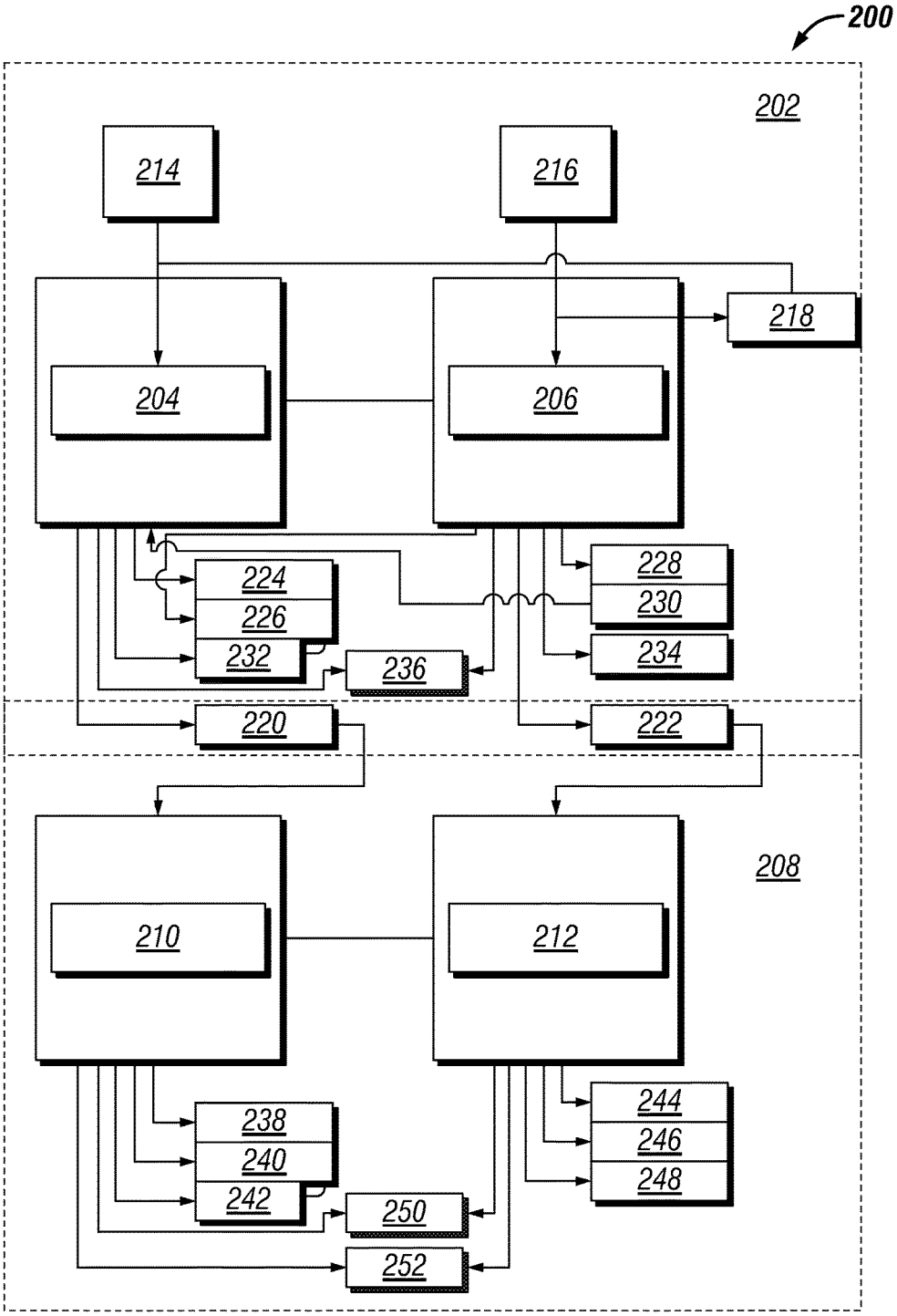
FIG. 2 is a schematic diagram showing the use of four PCHs in a BOP stack application.

Referring now to FIG. 2, a schematic diagram is provided showing the use of four PCHs in a BOP stack application. While in the embodiment shown four PCHs are used in a BOP stack application, any number of PCHs is envisioned for use in oil and gas operations in any suitable configuration for increased monitoring capabilities. PCH system 200 is comprised of two subsystems. LMRP subsystem 202 includes blue LMRP PCH 204 and yellow LMRP PCH 206. LS subsystem 208 includes blue LS PCH 210 and yellow LS PCH 212. Blue LMRP PCH 204 and yellow LMRP PCH 206 are the central power and communications hubs located on the LMRP, and blue LS PCH 210 and yellow LS PCH 212 are extensions of the LMRP PCHs 204, 206 and are located on the lower stack (see also 102, 104 in FIG. 1).

Blue LMRP PCH 204 interfaces with a MUX cable at blue MUX direct/blue MUX-XO connection interface 214, and yellow LMRP PCH 206 interfaces with a MUX cable at yellow MUX direct/yellow MUX-XO connection interface 216. In the embodiment shown, blue LMRP PCH 204 and yellow LMRP PCH 206 serve as the central power and communication system for subsea controls. The LS PCHs 210, 212 interface, via subsea cable and connector, with the lower stack stab and serve as an extension of the LMRP PCHs for lower stack subsystems and instrumentation. Additionally, in the embodiment shown, the LMRP PCHs 204, 206 feed power and communication to safety instrumented systems (SIS)-pod(s) 218 located on the LMRP.

Between LMRP subsystem 202 and LS subsystem 208, blue LMRP PCH 204 is operably coupled with blue LS PCH 210 by blue wedge connector 220. Between LMRP subsystem 202 and LS subsystem 208, yellow LMRP PCH 206 is operably coupled with yellow LS PCH 212 by yellow wedge connector 222. LMRP subsystem 202 further includes a first blue subsea electronics module (SEM) 224, a second blue SEM 226, a first yellow SEM 228, a second yellow SEM 230, an auxiliary LMRP connection 232, an acoustic monitoring system 234, and a new services connection for the LMRP 236. The blue LMRP PCH 204 provides for a primary connection to the first blue SEM 224, and a secondary connection to the second yellow SEM 230. The yellow LMRP PCH 206 provides for a primary connection to the first yellow SEM 228, a secondary connection to the second blue SEM 226, and a connection to acoustic monitoring system 234.

The blue LS PCH 210 further includes an accumulator pressure transducer 238, a high pressure/high temperature (HPHT) probe 240, and an auxiliary lower stack connection 242. The yellow LS PCH 212 provides an accumulator pressure connection 244, an HPHT probe connection 246, and acoustic monitoring LS connection 248. LS subsystem 208 also provides for an interface to a remotely operated vehicle (ROV) display 250 and LS new services connection 252.

In PCH system 200, the power system provides power as follows: six 24 volts direct current (VDC) buses for each SEM 224, 226, 228, 230 at the pods; two 24 VDC buses for RAM monitoring; four 24 VDC buses for future extensions (new services); one 24 VDC bus for acoustic monitoring connected to yellow LMRP PCH 206; one 24 VDC bus for acoustic monitoring connected to yellow LS PCH 212; one 24 VDC bus for non-safety critical future extensions connected to blue LMRP PCH 204; one 24 VDC bus for non-safety critical future extensions connected to blue LS PCH 210; and two 24 VDC buses for stack mounted instrumentation at the LS.

In PCH system 200, the communication system will provide communications as follows: one individual communication link to each SEM; two individual communication links for RAM monitoring; two individual communication links for future extensions (new services); one individual communication link to the acoustic monitoring system connected to yellow LMRP PCH 206; one individual communication link to acoustic monitoring connected to the yellow LS PCH 212; one individual communication link to a non-safety critical future service connected to blue LMRP PCH 204; one individual communication link to a non-safety critical future service connected to the blue LS PCH 210; two individual communication links to additional monitoring; two individual communication links for stack mounted instrumentation at the LS; and acoustic monitoring and other non-critical BOP subsystems shall have isolated communication links.

Figure 3A:
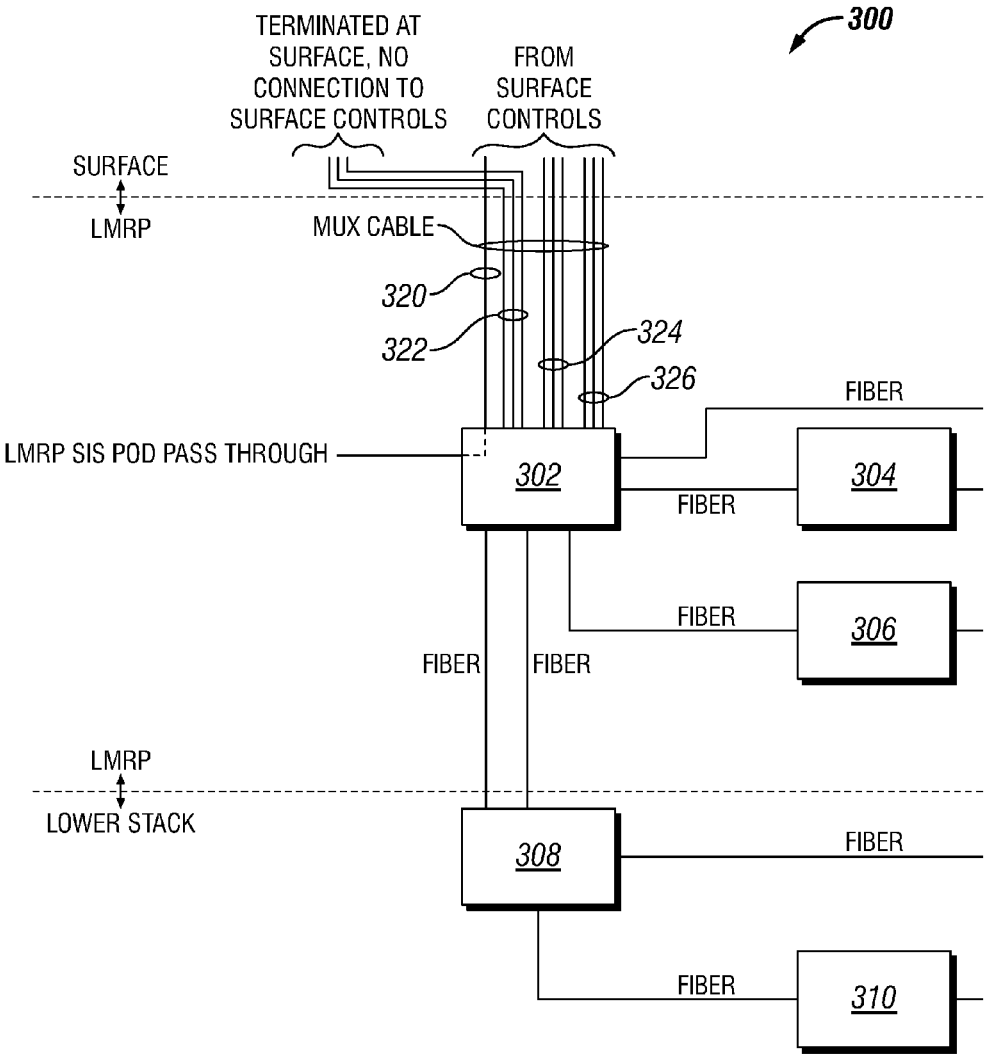
FIG. 3A is a schematic diagram showing 2 of 4 PCHs for use in a BOP stack application.
Figure 3B:
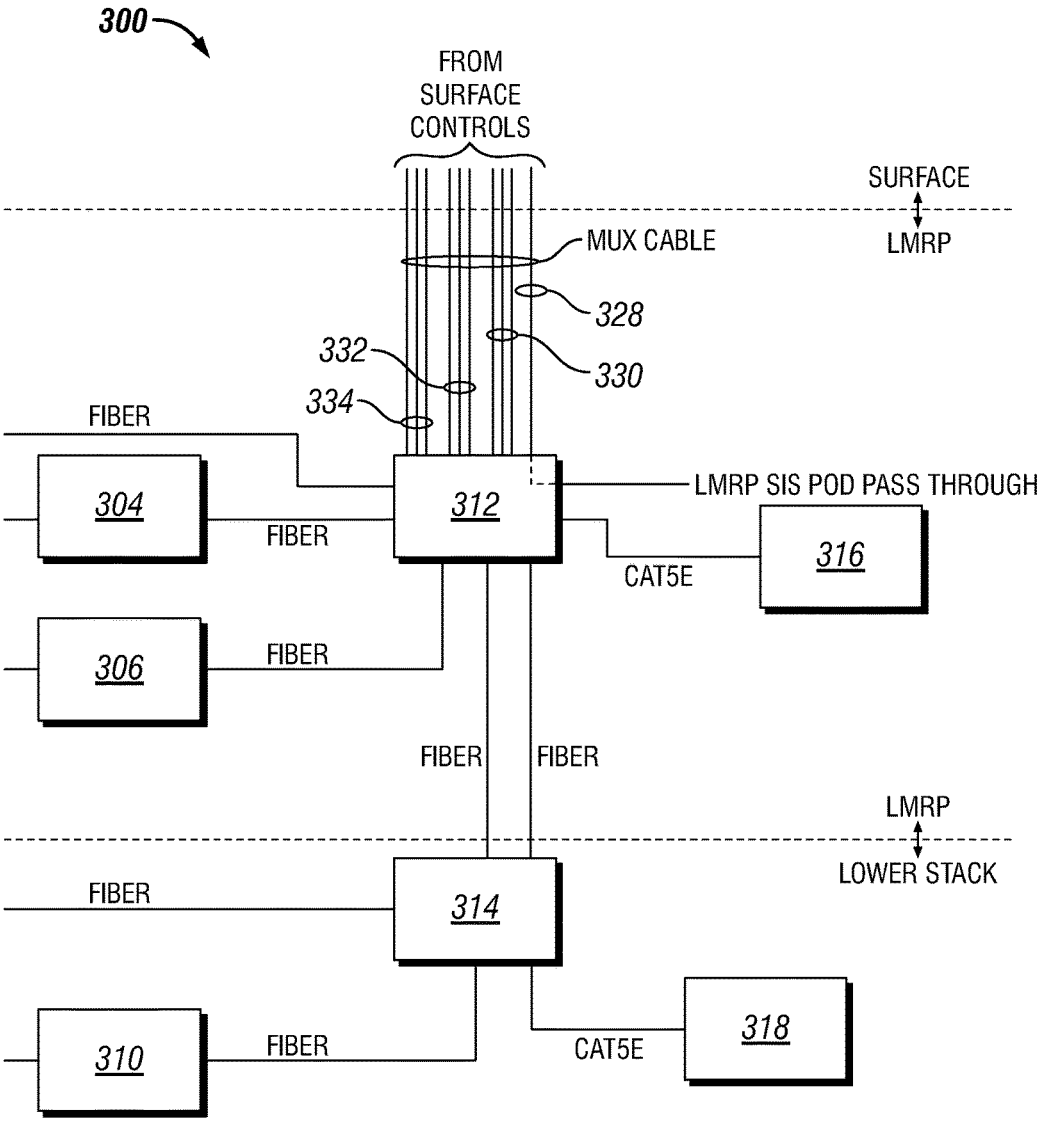
FIG. 3B is a schematic diagram showing 2 of 4 PCHs for use in a BOP stack application, continued from FIG. 3A.

FIG. 3A is a schematic diagram showing 2 of 4 PCHs for use in a BOP stack application. FIG. 3A is continued in FIG. 3B. FIG. 3A shows interfaces primarily associated with the blue side of a redundant subsea control system to other subsea elements and a surface control system. BOP system 300 includes blue LMRP PCH 302, a blue pod 304, a yellow pod 306, a blue LS PCH 308, and a RAM monitoring unit 310. FIG. 3B is a schematic diagram showing 2 of 4 PCHs for use in a BOP stack application, continued from FIG. 3A. FIG. 3B shows interfaces primarily associated with the yellow side of a redundant subsea control system to other subsea elements and a surface control system. BOP system 300 further includes yellow LMRP PCH 312, a yellow LS PCH 314, an LMRP acoustic monitoring pod 316, and an LS acoustic monitoring pod 318. Units 302, 304, 306, 308, 310, 312, and 314 are operably coupled and in communication by fibers as shown. Yellow LMRP PCH 312 is operably coupled to the LMRP acoustic monitoring pod 316 by a Category 5E (CAT5E) cable, and yellow LS PCH 314 is operably coupled to the LS acoustic monitoring pod 318 by a CAT5E Cable.

BOP system 300 includes a fiber 320 that is a pass through for the LMRP SIS pod. A fiber cluster 322 with 3 fibers provides no connection to surface controls and is terminated at the surface. Fiber cluster 322 includes fibers from surface data infrastructure electronics to a network switch for data infrastructure. A fiber cluster 324 with 3 fibers provides a connection to surface controls. Fiber cluster 324 includes fibers from a blue central command unit (CCU) connecting to a network switch for direct control. A fiber cluster 326 with 3 fibers provides a connection to surface controls. Fiber cluster 326 includes fibers from the blue CCU connecting to a network switch for crossover control. Communications for direct and crossover control are based on industrial network protocols (e.g. Modbus/Transmission Control Protocol (TCP)) for primary (blue) and redundant (yellow) controls.

BOP system 300 includes a fiber 328 that is a pass through for the LMRP SIS pod. A fiber cluster 330 with 3 fibers provides fibers connecting to an acoustic monitoring server. A fiber cluster 332 with 3 fibers provides a connection to surface controls. Fiber cluster 332 includes fibers from the yellow CCU connecting to a network switch for direct control. A fiber cluster 334 with 3 fibers provides a connection to surface controls. Fiber cluster 334 includes fibers from the yellow CCU connecting to a network switch for crossover control. Communications for direct and crossover control are based on industrial network protocols (e.g. Modbus/TCP) for primary (yellow) and redundant (blue) controls.

Figure 4:
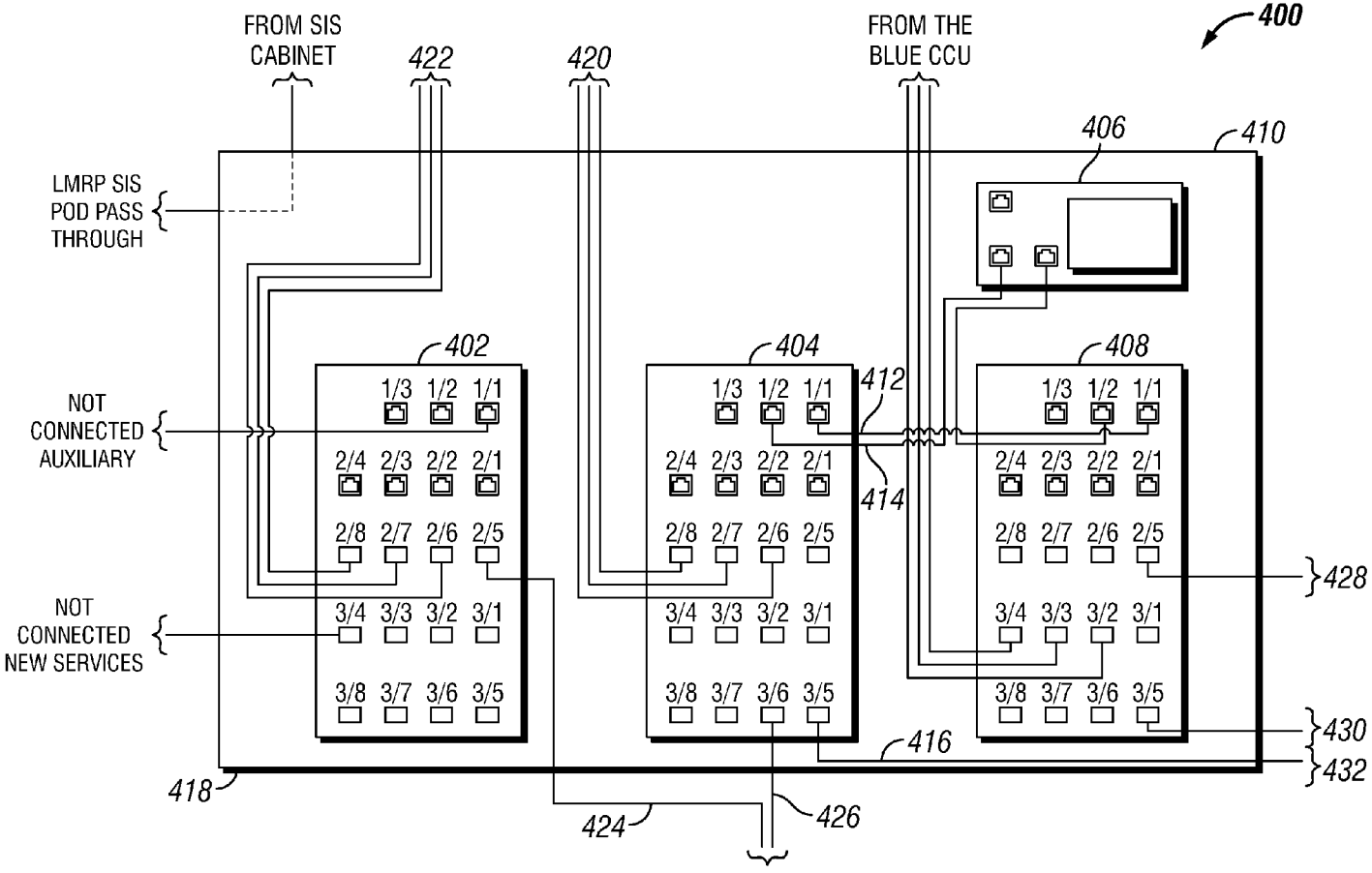
FIG. 4 is a schematic diagram showing a lower marine riser package (LMRP) PCH network switch interface.

Referring now to FIG. 4, an example LMRP PCH network switch interface 400 is shown. The LMRP PCH communications subsystem serves as a gateway for subsea communications. Communication links are terminated from the MUX output and linked to their appropriate interface. The LMRP PCH communication sub system provides a communication crossover to and from the coinciding LMRP PCH. The crossover serves as a means of redundant communications.

FIG. 4 is a schematic diagram also showing a blue lower marine riser package (LMRP) PCH network switch interface. LMRP PCH network switch interface 400 includes a network switch for data infrastructure 402, an independent network switch for direct control 404, a blue PCH central processing unit (CPU) 406, and a network switch for crossover control 408 of yellow subsea systems. Cat 5E cable connection 414 (port 1/2) is directly connected to the blue CPU. Cat 5E cable connection 412 (port 1/1) provides a network connection to the crossover control network switch linking the redundant controls systems together. Cable connection 416 (port 3/3) provides a network link to the blue pod through the primary SEM. In FIG. 4, 410 and 418 are not fiber connections, but instead they are lines of an outline of a box indicating the housing of the blue LMRP PCH. Numbers such as ⅓, ½, etc. are port identifiers on the network switch.

In FIG. 4, fiber cluster 420 is operably coupled to a blue CCU, and fiber cluster 422 is terminated at the surface with no connection to the surface control. Fibers 424, 426 proceed to a blue lower stack PCH, such as, for example, blue LS PCH 210 in FIG. 2. A fiber 428 is operably coupled to a yellow LMRP PCH, such as, for example, yellow LMRP PCH 206 in FIG. 2. Fiber 430 connects to a secondary SEM on a yellow pod, such as, for example, second yellow SEM 230 in FIG. 2. Fiber 432 connects to a first SEM on a blue pod, such as, for example, first blue SEM 224 in FIG. 2.

Figure 5A:
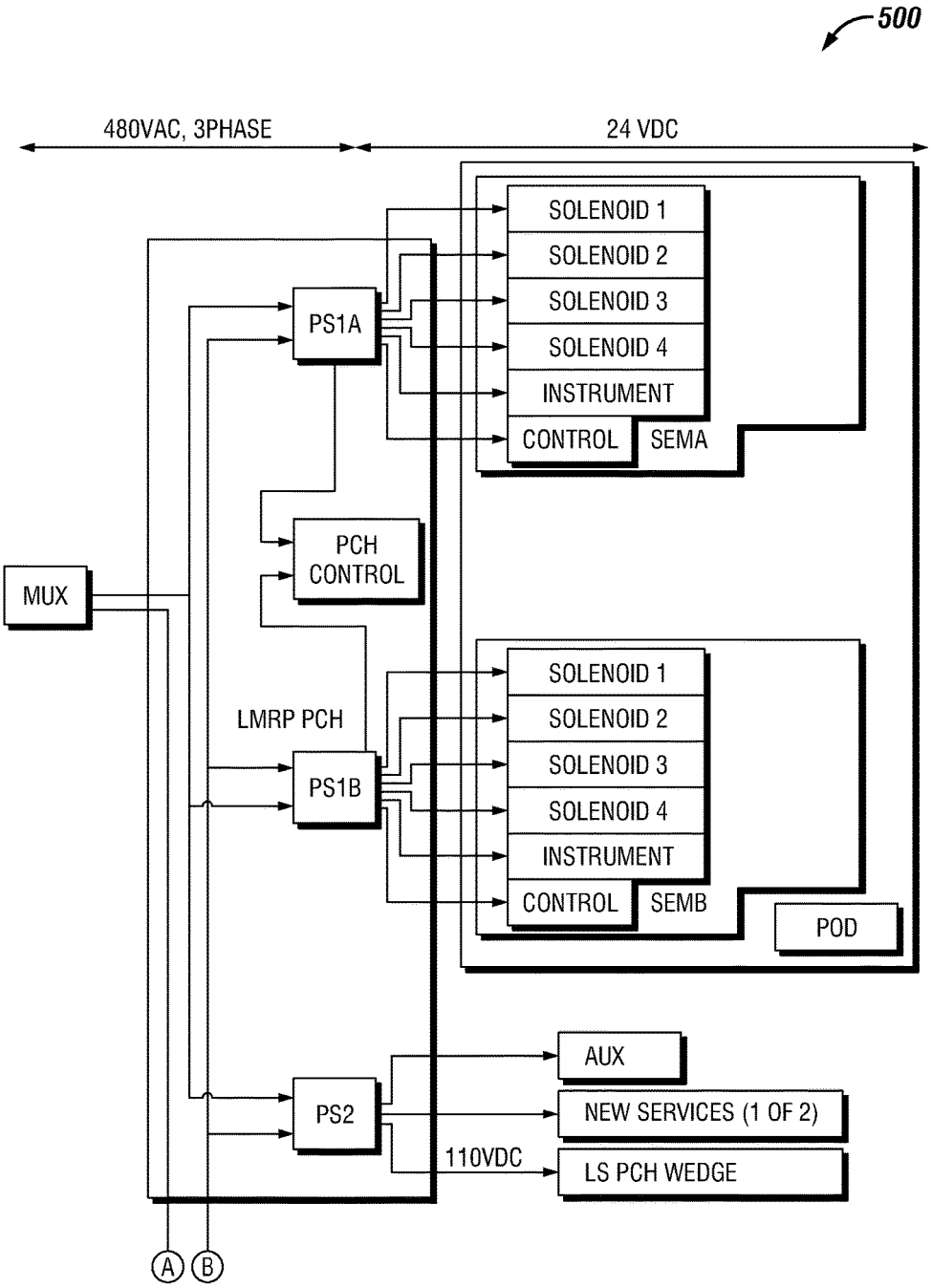
FIG. 5A is a schematic diagram showing specific interface details between an LMRP PCH and LMRP control, instrumentation, and monitoring elements.
Figure 5B:
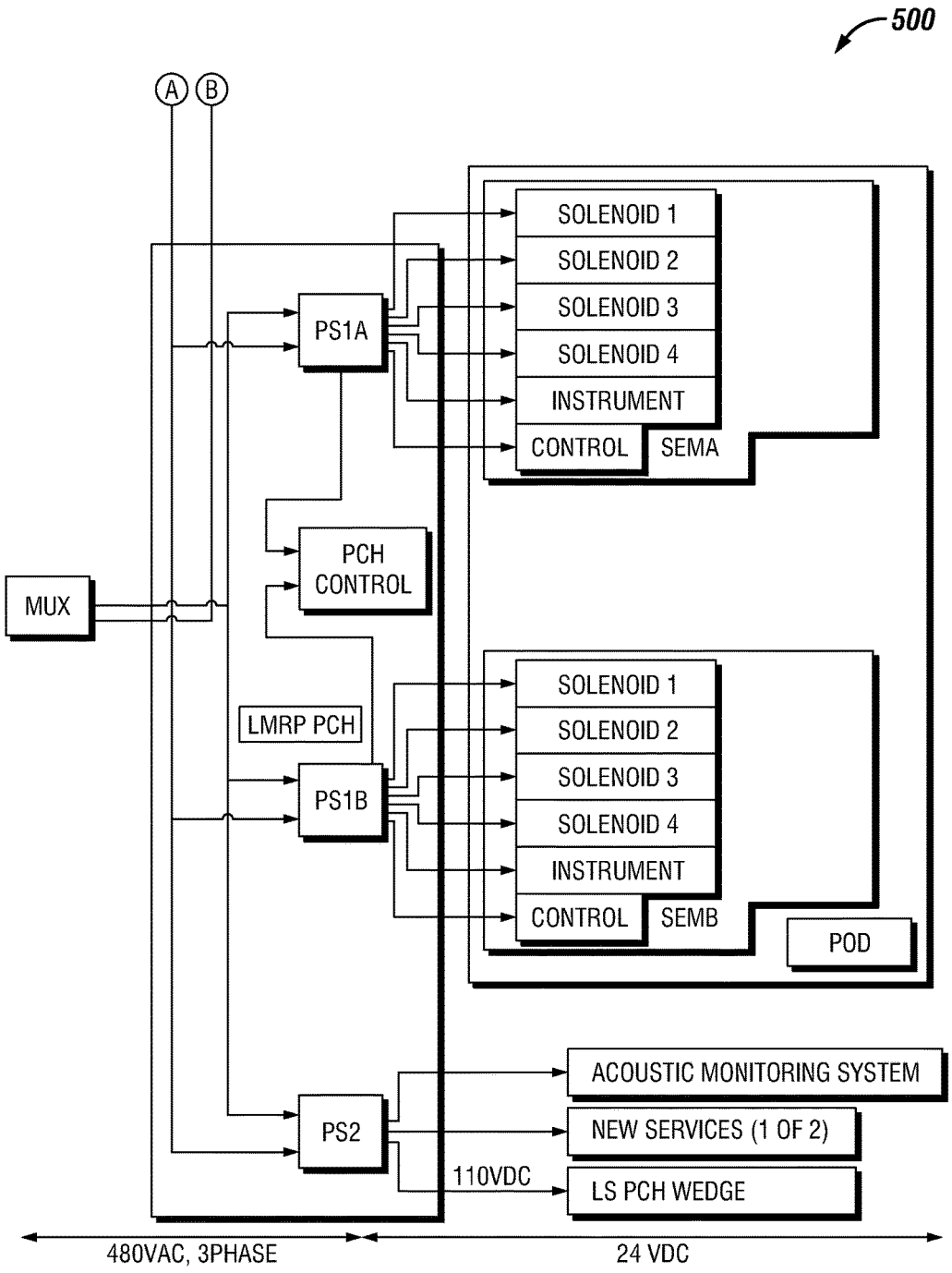
FIG. 5B is a schematic diagram showing specific interface details between an LMRP PCH and LMRP control, instrumentation, and monitoring elements.

FIGS. 5A and 5B are schematic diagrams showing specific interface details between the LMRP PCH and LMRP control, instrumentation, and monitoring elements. LMRP PCH power subsystem 500 converts delta 3 phase 480 volt alternating current (VAC) 50 Hz to 110 VDC and 24 VDC to serve as voltages for BOP subsea controls. PS1A provides 4 independent 24 VDC power rails for solenoids, an independent 24 VDC rail for pod instrumentation, and an independent 24 VDC rail for SEM control. PS1B provides a fully redundant set of 24 VDC power rails as PS1A to redundant elements within the same pod. PS2 provides an independent 24 VDC to new services, and independent 24 VDC to auxiliary services, and 110 VDC as supply voltage to the LS PCH. PCH Control provides control functionality for elements internal to LMRP PCH power subsystem 500. Certain acronyms as used herein are listed as follows: Printed Circuit Board Assembly (PCBA); Power Supply 1A (PS1A); Power Supply 1B (PS1B); Pressure Balanced Oil-Filled (PBOF).

Figure 6:
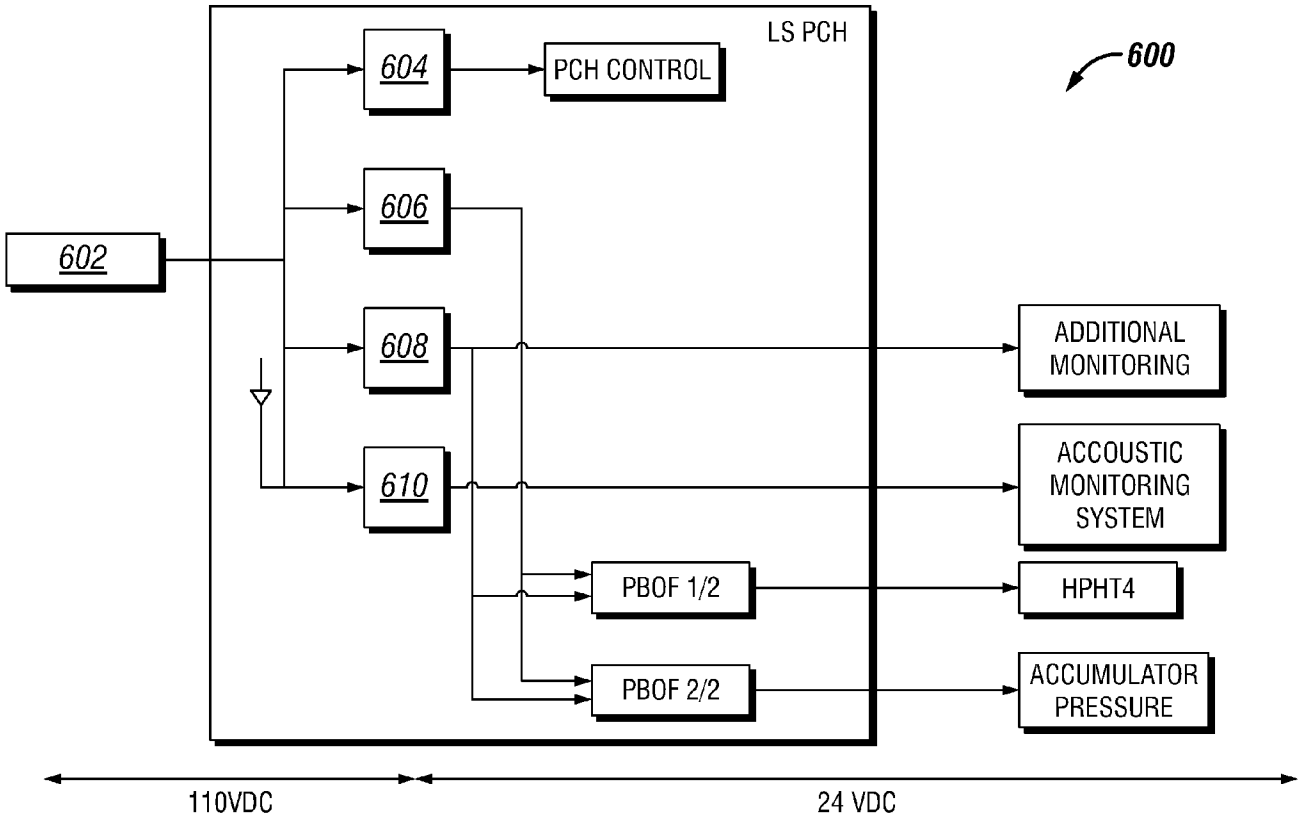
FIG. 6 is a schematic diagram showing specific interface details between a lower stack (LS) PCH and LS control, instrumentation, and monitoring elements.

FIG. 6 is a schematic diagram showing specific interface details between a lower stack (LS) PCH and LS control elements. In LS system 600, LS PCH Wedge 602 is operably coupled to LS PCH control elements 604, 606, 608, and 610. Control elements 604, 606, 608, and 610 in LS system 600 each provide a 24 VDC power rail to elements on the LS. Power supply control element 604 provides 24 VDC supply power to the internal PCH control element. Power supply control element 606 provides 24 VDC supply power to the accumulator pressure transducer. Power supply control element 608 provides 24 VDC supply power to additional monitoring. Power supply control element 610 provides supply power to the LS acoustic monitoring system.

In the various embodiments of the disclosure described, a person having ordinary skill in the art will recognize that alternative arrangements of components, units, conduits, and fibers could be conceived and applied to the present invention.

The singular forms "a," "an," and "the" include plural referents, unless the context clearly dictates otherwise.

Examples of computer-readable medium can include but are not limited to: one or more nonvolatile, hard-coded type media, such as read only memories (ROMs), CD-ROMs, and DVD-ROMs, or erasable, electrically programmable read only memories (EEPROMs); recordable type media, such as floppy disks, hard disk drives, CD-R/RWs, DVD-RAMs, DVD-R/RWs, DVD+R/RWs, flash drives, memory sticks, and other newer types of memories; and transmission type media such as digital and analog communication links. For example, such media can include operating instructions, as well as instructions related to the systems and the method steps described previously and can operate on a computer. It will be understood by those skilled in the art that such media can be at other locations instead of, or in addition to, the locations described to store computer program products, e.g., including software thereon. It will be understood by those skilled in the art that the various software modules or electronic components described previously can be implemented and maintained by electronic hardware, software, or a combination of the two, and that such embodiments are contemplated by embodiments of the present disclosure.

The invention claimed is:

1. A power and communications hub (PCH) for oil and gas operations, the PCH comprising:

a port operable to provide electrical power to a device for use in oil and gas operations;

a port operable to provide electrical communications for use in oil and gas operations;

a multiplexer (MUX) interface for connection to a MUX cable;

a PCH connection interface for connection to at least one additional PCH for providing power and communication between the PCH and the additional PCH; and a PCH body, wherein the PCH body is operable to be disposed proximate a blowout preventer (BOP) stack, wherein the PCH body is physically disposed apart from but in electrical communication with at least one control pod on the BOP stack.

2. The PCH according to claim 1, wherein the PCH is operable to feed electrical power and electrical communications to safety instrumented systems (SIS)-pods located on the BOP stack.

3. The PCH according to claim 1, wherein the PCH is operable to connect to a first subsea electronics module (SEM) and a second SEM.

4. The PCH according to claim 1, wherein the PCH provides an auxiliary lower marine riser package (LMRP) connection.

5. The PCH according to claim 1, wherein the PCH provides a connection to a remotely operated vehicle (ROV) display.

6. The PCH according to claim 1, wherein the PCH provides a connection for new services on the BOP stack.

7. The PCH according to claim 1, wherein the PCH comprises a PCH network switch interface comprising a network switch for data infrastructure, a network switch for direct control, a PCH central processing unit (CPU), and a network switch for crossover control.

8. A PCH system for subsea oil and gas operations, the PCH system comprising:

a first LMRP PCH, wherein the first LMRP PCH comprises:

a port operable to provide electrical power to a device for use in oil and gas operations;

a port operable to provide electrical communications for use in oil and gas operations;

a MUX interface for connection to a MUX cable;

a PCH connection interface for connection to at least one additional PCH; and a PCH body, wherein the PCH body is operable to be disposed proximate a BOP stack, and wherein the PCH body is physically disposed apart from but in electrical communication with at least one control pod on the BOP stack;

a second LMRP PCH;

a first lower stack (LS) PCH; and a second LS PCH.

9. The PCH system according to claim 8, wherein the first LMRP PCH and the first LS PCH are operably coupled through a first wedge connector.

10. The PCH system according to claim 8, wherein the second LMRP PCH and the second LS PCH are operably coupled through a second wedge connector.

11. The PCH system according to claim 8, wherein the first LMRP PCH and second LMRP PCH are operable to feed electrical power and electrical communications to SIS-pods disposed proximate the BOP stack.

12. The PCH system according to claim 8, wherein the first LMRP PCH and second LMRP PCH are each operable to connect to a first SEM and a second SEM.

13. The PCH system according to claim 8, wherein the first LS PCH and second LS PCH provide connections to an ROV display.

14. The PCH system according to claim 8, wherein a power system comprises: six 24 volts direct current (VDC) buses for each SEM connection; two 24 VDC buses for RAM monitoring; four 24 VDC buses for new services; one 24 VDC bus for acoustic monitoring connected to yellow LMRP PCH 206; one 24 VDC bus for acoustic monitoring connected to yellow LS PCH 212; one 24 VDC bus for non-safety critical future extensions connected to blue LMRP PCH 204; one 24 VDC bus for non-safety critical future extensions connected to blue LS PCH 210; and two 24 VDC buses for stack mounted instrumentation at the LS.

15. The PCH system according to claim 8, wherein a communication system comprises: one individual communication link to each SEM; two individual communication links for RAM monitoring; two individual communication links for new services; one individual communication link to an acoustic monitoring system to an LMRP PCH; one individual communication link to acoustic monitoring connected to an LS PCH; one individual communication link to a non-safety critical future service connected to an LMRP PCH; one individual communication link to a non-safety critical future service connected to the an LS PCH; two individual communication links to additional monitoring; two individual communication links for stack mounted instrumentation at the LS; and acoustic monitoring and other non-critical BOP subsystems having isolated communication links.

16. A method for decentralizing power and communications in subsea BOP stack control pods, the method comprising the steps of:

introducing at least one PCH to a BOP stack, wherein the at least one PCH is operable to provide power and communications for existing BOP stack components and future BOP stack components; and operating the at least one PCH to provide required power and communications to components on the BOP stack from surface controls, wherein the at least one PCH is physically disposed apart from but in electrical communication with at least one control pod on the BOP stack, and wherein the at least one PCH is configured to provide power and communication between the PCH and an additional PCH.

17. The method according to claim 16, further comprising the step of operably connecting the at least one PCH to the additional PCH such that the at least one PCH and the additional PCH via a PCH connection interface for providing the power and the communication between the at least one PCH and the additional PCH.

18. The method according to claim 16, further comprising the step of utilizing the PCH to feed electrical power and electrical communications to safety instrumented systems (SIS)-pods located on the BOP stack.

19. The method according to claim 16, further comprising the step of operably connecting the PCH with a first SEM and a second SEM.

20. The method according to claim 16, further comprising the step of providing a connection to an ROV display.

21. A PCH system for subsea oil and gas operations, the PCH system comprising:

a first LMRP PCH, wherein the first LMRP PCH comprises:

a port operable to provide electrical power to a device for use in oil and gas operations;

a port operable to provide electrical communications for use in oil and gas operations;

a MUX interface for connection to a MUX cable;

a PCH connection interface for connection to at least one additional PCH for providing power and communication between the first LMRP PCH and the additional PCH; and a PCH body, wherein the PCH body is operable to be disposed proximate a BOP stack, wherein the PCH body is physically disposed apart from but in electrical communication with at least one control pod on the BOP stack; and a second LMRP PCH.

22. The PCH system of claim 21, further comprising:

a first lower stack (LS) PCH; and a second LS PCH.

* * * * *